United States Patent [19]

Trask et al.

[11] Patent Number: 4,863,044

[45] Date of Patent: Sep. 5, 1989

[54] LATTICEWORK CONSTRUCTION FOR CRANES

[75] Inventors: Walter H. Trask; Neil F. Lampson, both of Kennewick, Wash.

[73] Assignee: Neil F. Lampson, Inc., Kennewick, Wash.

[21] Appl. No.: 139,409

[22] Filed: Dec. 30, 1987

[51] Int. Cl.[4] ..... B66C 23/64

[52] U.S. Cl. ..... 212/189; 212/255; 212/266; 52/116

[58] Field of Search ..... 212/175, 177, 266, 189, 212/255; 52/116, 633, 660, 664, 720, 726, 732

[56] References Cited

U.S. PATENT DOCUMENTS

| | | | |
|---|---|---|---|
| 844,990 | 2/1907 | Allan et al. | 212/177 |
| 2,053,157 | 9/1936 | Ljungkull | 212/266 |
| 3,021,014 | 2/1962 | Korensky et al. | 212/177 |
| 3,249,238 | 5/1966 | Hedeen . | |
| 3,323,660 | 6/1967 | Allin | 212/177 |
| 3,511,388 | 5/1970 | Markwardt . | |
| 3,955,684 | 5/1976 | Novotny . | |
| 4,394,911 | 7/1983 | Wittman et al. | 212/189 |
| 4,484,686 | 11/1984 | Mentzer | 212/177 |
| 4,537,317 | 8/1985 | Jensen | 212/189 |
| 4,621,742 | 11/1986 | Rathi | 212/177 |

*Primary Examiner*—Sherman D. Basinger
*Assistant Examiner*—Stephen P. Avila
*Attorney, Agent, or Firm*—Wells, St. John & Roberts

[57] ABSTRACT

A crane, and a boom assembly for a crane, include an outermost boom portion having the area between its front chord members being substantially open. Inner lacing members extend in intersecting pairs between diagonally opposing pairs of chord members for strengthening the boom. The various lacing members in the latticework construction for a crane are connected to the chord members using reusable clevis pin assemblies of a predetermined tolerance. This enables it to be easily assembled and to be readily disassembled for ease of transport and storage in a compact state. It also produces a rigid structure having substantially no internal residual stress.

28 Claims, 5 Drawing Sheets

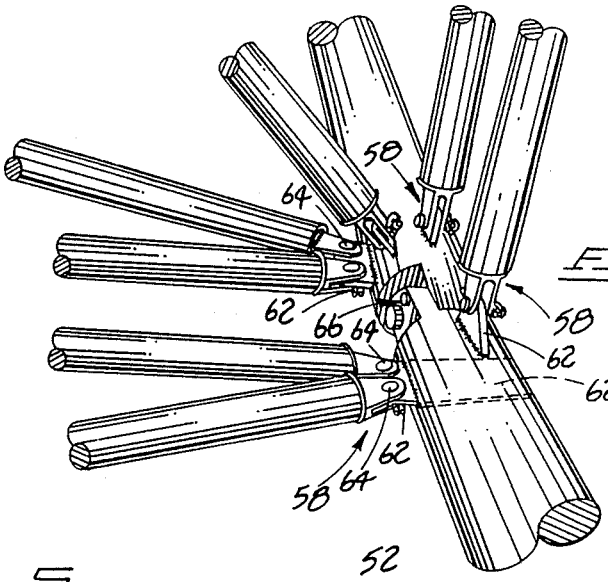
FIG 6
FIG 5
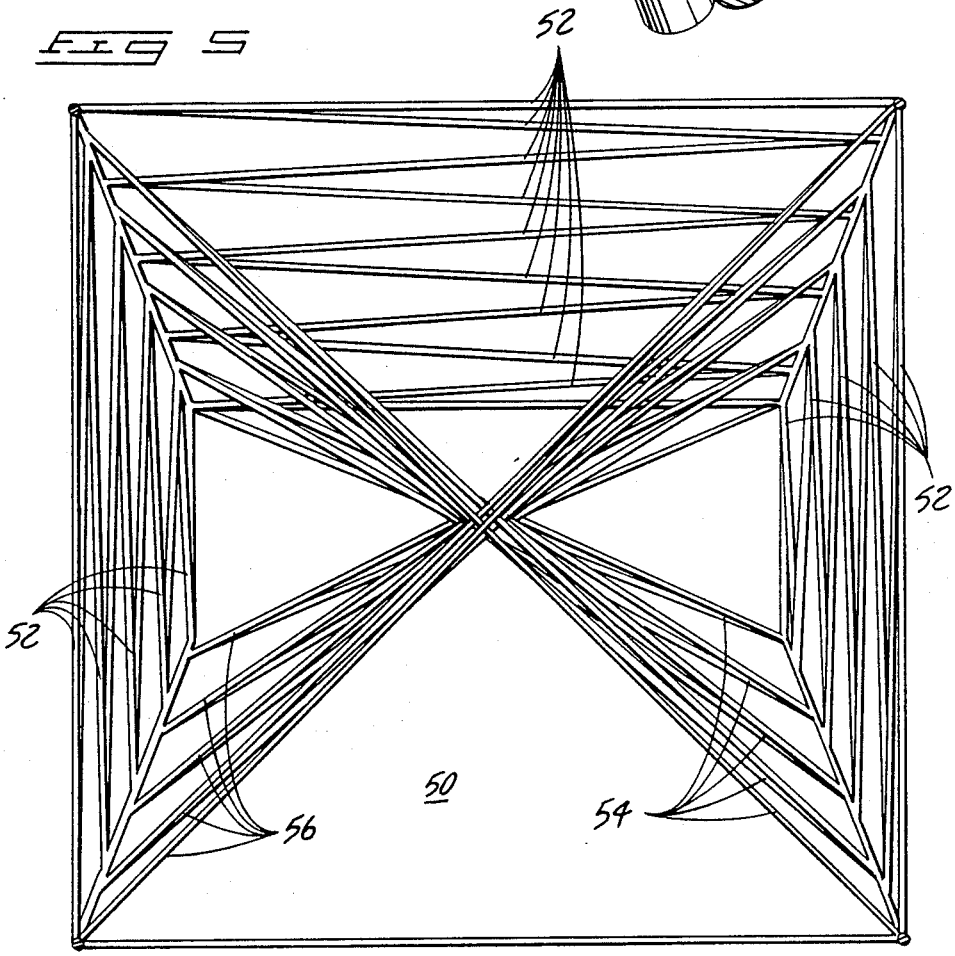

LATTICEWORK CONSTRUCTION FOR CRANES

TECHNICAL FIELD

This invention relates to latticework construction for cranes.

BACKGROUND OF THE INVENTION

For purposes of this disclosure the term "crane" shall refer to any hoisting equipment designed to pick up a load, transport it a limited distance, and deposit it at a new location. The term "latticework construction" refers to structural crane members of open truss design including four chords and interconnected three-dimensional lacing extending across and diagonally between the chords. While the novel latticework construction shall be described in relation to the upright boom on a mobile crane, it is to be understood that it is also applicable to other common crane components, including (but not limited to) auxiliary booms or jigs, towers, masts, gantries, derricks and gin poles.

Load supporting cranes are commonly used in building and other construction for moving very heavy objects. Such cranes commonly employ a boom assembly which is pivotally mounted at one end to a stationary or mobile base support. Suitable cable rigging is employed to alter the inclination of the boom assembly with respect to the ground in order to perform the various functions for which the crane was made. The construction and crane industry in recent years has employed increasingly longer and larger boom assemblies in order to meet the requirements and demands of today's construction and excavation needs.

Such large boom assemblies are generally constructed in a plurality of disconnectable segments to permit dismantling for transportation between construction sites. The boom segments are made of a plurality of longitudinal chord members interconnected by a plurality of lacing members to provide the desired structural strength. Terminal end portions of each chord member are typically provided with suitable connections for securing abutting boom segments together.

The outermost, or tip, boom segment typically includes a weldment assembly for movably supporting hoist cables which carry a load block for engaging the various items to be moved by the crane. It is generally important that the area between the front chord members be open along the length of the tip boom segment to enable the hoist cables to enter within the cross-sectional area of the tip segment when the boom assembly is pivoted to its maximum upward position. By providing reaction forces to the load within the cross-sectional area of the outermost boom segment in such condition, the loads on the boom are better distributed among all four chord members in each of the segments. If the front area across the boom section were closed, it would be necessary to project the hoist cable carrying weldment assembly forwardly to prevent the cables from bearing against lacing members of the boom tip segment when the assembly is pivoted to its maximum upwardly position (80°). However, this projection would exert greatly unbalanced forces on the front and rear chords along the boom.

These concepts of crane and boom assembly construction are, for example, illustrated in U.S. Pat. Nos. 3,249,238 to Hedeen; 3,511,388 to Markwardt; 3,955,684 to Novotny; 4,394,911 to Wittman et al.; 4,537,317 to Jensen; and 4,621,742 to Rathi. Such cranes, however, are not without drawbacks. To provide this open front area in the outermost boom segment, an alternate way of providing support between the pair of front chord members must be provided. For example, intersecting lacing members generally extend between each of the two side and rear pairs of chord members to rigidify the segment. However, were such lacing members to extend between the front chord members, the hoist cables would not be permitted to enter into the cross sectional volume of the outermost boom segment when raised to its most upwardly position.

The Hedeen U.S. Pat. No. 3,249,238 teaches overcoming this problem by employing additional longitudinal front chord members which outwardly expand to provide an open area for receiving the hoist cables along the substantial length of the front of the boom segment. Other elaborate rigidifying connections are typically employed which extend between and interconnect the front pair of chord members while providing an open space for enabling the hoist cables to extend through the cross sectional volume. However, all such interconnections tend to diminish the structural load carrying capacity of the outermost boom tip segment (and correspondingly the entire boom assembly) below that which would be present if lacing members extended between the front chord members in the same manner they extend between the rear and side chord member pairs.

A further separate drawback with typical large cranes includes difficulties in their transport between construction sites. Even though adjacent boom segments are separable from one another, enabling the length of the boom assembly to be reduced for ease of transport, the cross sectional size of each individual boom segment can become too large for transport on conventional highways. For example, the width and height span of individual boom segments in large cranes can exceed fourteen feet. Placing such segments on trailer beds for transportation along a highway produces a vehicle having a height and width which exceed the maximum allowable for most highways and bridges.

Yet another separate problem relating to existing cranes involves built-in pre-stress that occurs during manufacture. For example, many boom assemblies, and each of the boom segments of a multi-segmented boom assembly, have the lacing and chord members interconnected by welding. As each such boom or boom segment is constructed, internal or residual stresses are inherently built into the finished structure when the various members are positioned and welded. These internal stresses diminish the load carrying capacity of the boom or boom segment that would otherwise be attainable were it practical to construct a stress-free boom or boom segment of the same size. These internal stresses also add to the cyclic moment loading that occurs at each connection weld point and can contribute to fatigue and premature failure of the weld. Because of this diminished load carry capacity, booms or boom segments must be manufactured to have a larger cross sectional span for a given load capacity than would be necessary were no pre-stress present. Accordingly, this problem compounds the size requirement of the boom or boom segment, further aggravating the transportation problems associated with large cranes.

Concepts employed by the present invention enable drawbacks such as these to overcome.

BRIEF DESCRIPTION OF THE DRAWINGS

The preferred embodiment of the invention is illustrated in the accompanying drawings, in which:

FIG. 5 is a diagrammatic sectional view taken along line 5—5 in FIG. 1; and

FIG. 6 is an enlarged, fragmented, perspective view of the interconnection area of a chord member of the outermost boom tip segment to that of an adjacent intermediate boom segment.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 1:
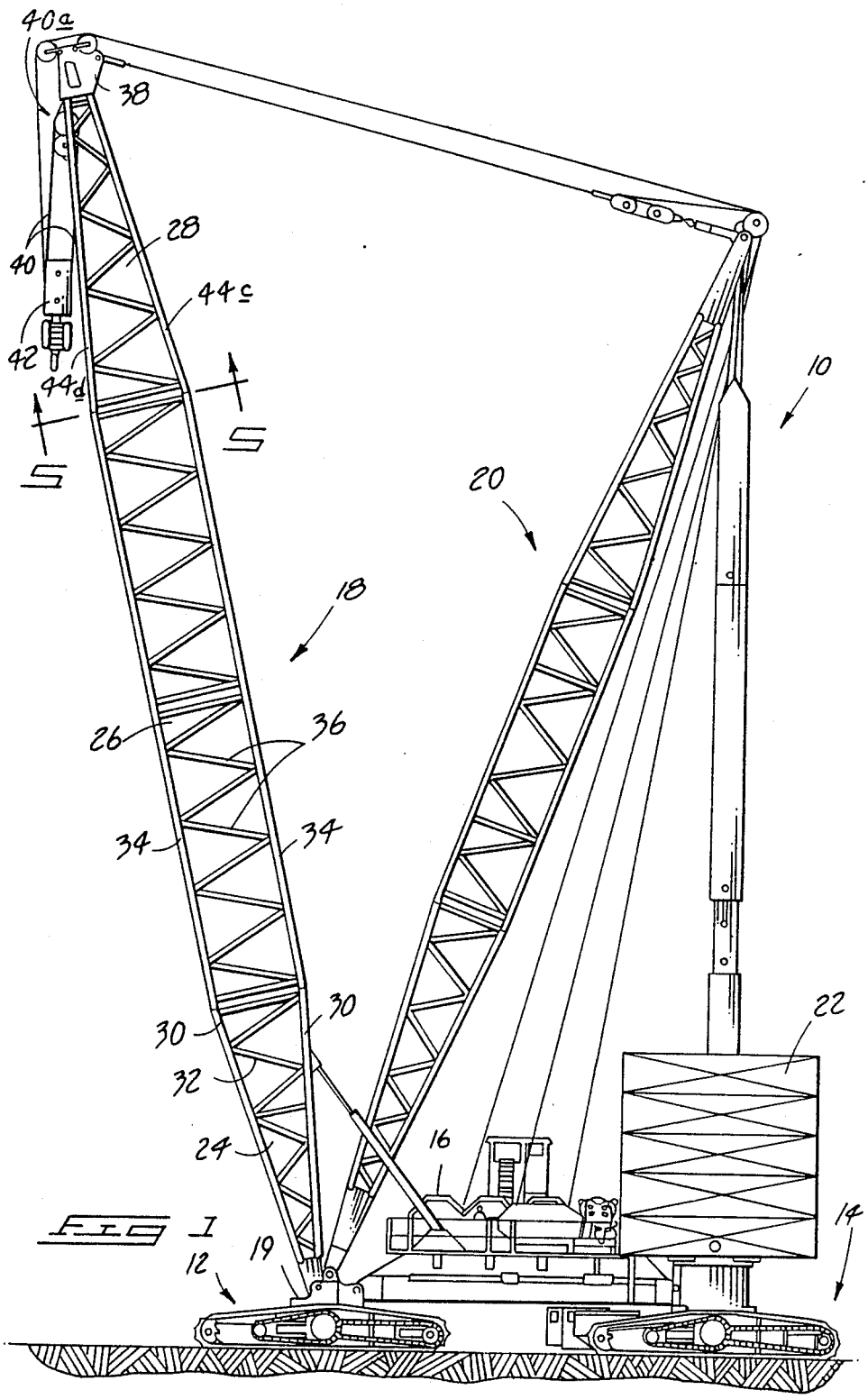
FIG. 1 is a side elevation view of a crane and boom assembly in accordance with the invention.

Referring to FIG. 1, a heavy duty crane in accordance with the invention is indicated generally by reference numeral 10. Crane 10 includes a power driven main mobile unit 12 and a power driven second mobile unit or transporter 14. Mobile unit 12 and transporter 14 are spaced from each other by a rigid stinger 16. Main mobile unit 12 supports a forwardly extending boom assembly 18 and a rearwardly extending mast 20. Transporter 14 supports a counterweight 22 which operatively connects to the upper end of boom assembly 18 through mast 20 by backstay struts.

Boom assembly 18 is comprised of a plurality of abutting and generally coaxial boom segments 24, 26, 28 which extend in a defined longitudinal direction. The innermost, or heel, segment 24 includes pivotal connection means 19 for connecting the entire boom assembly to main mobile unit 14. Heel segment 24 is comprised of four longitudinal chords 30 which outwardly expand from the heel end connection location where the segment pivotally attaches to boom support main carrier 12. A plurality of outer lacing members 32 angle between adjacent chord members 30 about the periphery of heel segment 24 to interconnect chord members 30 and strengthen the segment and boom assembly. A preferred method for connecting outer lacing members and chord members will be described subsequently.

Intermediate boom segment 26 extends from the widest, end portion of heel boom segment 24. It includes four chord members 34 which are each connected to one of chord members 30 of heel boom segment 24. Chord members 34 extend in parallel fashion relative to one another. Outer lacing members 36 angle between adjacent chord members 34 about the periphery of intermediate boom segment 26 to interconnect chord members 34 and strengthen the segment and boom assembly.

Referring to FIGS. 1–5, tip boom segment 28 comprises four longitudinal chord members 44*a*, 44*b*, 44*c* and 44*d*, each having a coextensive proximal end 46 and a distal end 48. Each of the proximal ends 46 attaches to the outer end of one of the chord members 34 of intermediate boom segment 26. Chord members 44*a–d* angle inwardly towards one another to the end of segment 28, wherein their distal ends 48 are closer to one another than are their proximal ends 46. A conventional support means is included at the distal ends 48 of chord members 44*a–d* for mounting a weldment assembly 38. Weldment assembly 38 movably carries hoist cables 40 which support a movable load block 42 which suspends the objects being supported by the crane. The conventional support means and weldment assembly 38 have been removed from FIGS. 2–5 for clarity of construction of boom segment 28.

For ease of description, the individual chord members can be considered as presenting pairs of chord members. For example, chord members 44*a*, 44*d* define a pair of front chord members. Chord members 44*b*, 44*c* define a pair of rear chord members. Chord members 44*a*, 44*b* and chord members 44*c*, 44*d* define two pairs of side chord members. Further, chord members 44*a*, 44*c* present a first pair of diagonally opposed chord members, while chord members 44*b*, 44*d* present a second pair of diagonally opposed chord members. Each of the chord members of each of the above-defined pairs are separated from one another thereby defining a space therebetween. Chord members 44*a–d* also define an inner cross-sectional volume 50 bounded by such chord members.

A plurality of outer lacing members 52 extends between and interconnects chord member 44a which chord member 44*b;* chord member 44*b* which chord member 44*c;* and chord member 44*c* with chord member 44*d*. Outer lacing members 52 extend between their respective chord members in an angled or intersecting pair, and zigzag fashion. In this manner, each pair of rear and side chord members are interconnected by outer lacing members. The outer lacing members preferably are connected to the chord members at connection locations such that imaginary centerlines extending from their ends intersect generally at the centerline of a chord member. This prevents localized eccentric loading of the chord members and provides predictable force diagrams for the respective lacing and chord member junctions. Alternately and less preferred, lacing members could be spaced from one another, which would widen the area defining the connection locations.

A plurality of first inner lacing members 54 extends between and interconnects the first pair of diagonally opposed chord members 44*a*, 44*c*. For ease of description, the collective first inner lacing members 54 define a first inner lacing member set.

First inner lacing members 54 of the first set extend between diagonally opposed chord members 44*a*, 44*c* in intersecting pairs from each of connection locations 151, 153, 155 and 157 or alternately connection locations 152, 154, 156, 158. For example, traversing the path from the proximal to the distal ends of segment 28, inner lacing members 54 extend from the proximal end of front chord member 44*a*, defined by location 150, to a location 159 at the distal end of rear chord member 44*c*. Accordingly, inner lacing members 54 extend between each of locations 150, 151; 151, 152; 152, 153; 153, 154; 154, 155; 155, 156; 156, 157; 157, 158; and 158, 159. Any two adjacent inner lacing members 54 which collectively extend between any three consecutively numbered locations (i.e. 150, 151, 152) define an intersecting pair which extend from the mid-connection location (in this example, 151). Accordingly, in the depicted embodiment, locations 151, 152, 153, 154, 155, 156, 157 and 158 are each connection locations from which an intersecting pair of first inner lacing members 54 extends. The collective connection locations 151 through 158 define a first set of longitudinally spaced connection locations.

A plurality of second inner lacing members 56 extends between and interconnects the second pair of diagonally opposed chord members **44*d*, 44*b*. The collective second interlacing members 56** define a second inner lacing member set.

Second inner lacing members 56 of the second set extend between diagonally opposed chord members **44*d*, 44*b* in intersecting pairs from connection locations 251, 253, 255 and 257, or alternately connection locations 252, 254, 256 and 258. For example, traversing the path from the proximal to the distal ends of segment 28, inner lacing members 56 extend from the proximal end of front chord member 44*d*, defined by location 250, to a location 259 at the distal end of rear chord member 44*b*. Accordingly, inner lacing members 56 extend between each of locations 250, 251; 251, 252; 252, 253; 253, 254; 254, 255; 255, 256; 256, 257; 257, 258; and 258, 259. Any two adjacent inner lacing members 56 which collectively extend between any three consecutively numbered locations (i.e., 255, 256, 257) define an intersecting pair which extend from the mid-connection location (in this example, 256). Accordingly, in the depicted embodiment, locations 251, 252, 253, 254, 255, 256, 257 and 258 are each connection locations from which an intersecting pair of second interlacing members 56 extends. The collective connection locations 251 through 258** define a second set of longitudinally spaced connection locations.

As with the outer lacing member connection locations, all inner lacing members preferably connect such that imaginary centerlines of an intersecting pair extend to intersect generally at the centerline of a chord member.

Figure 2:
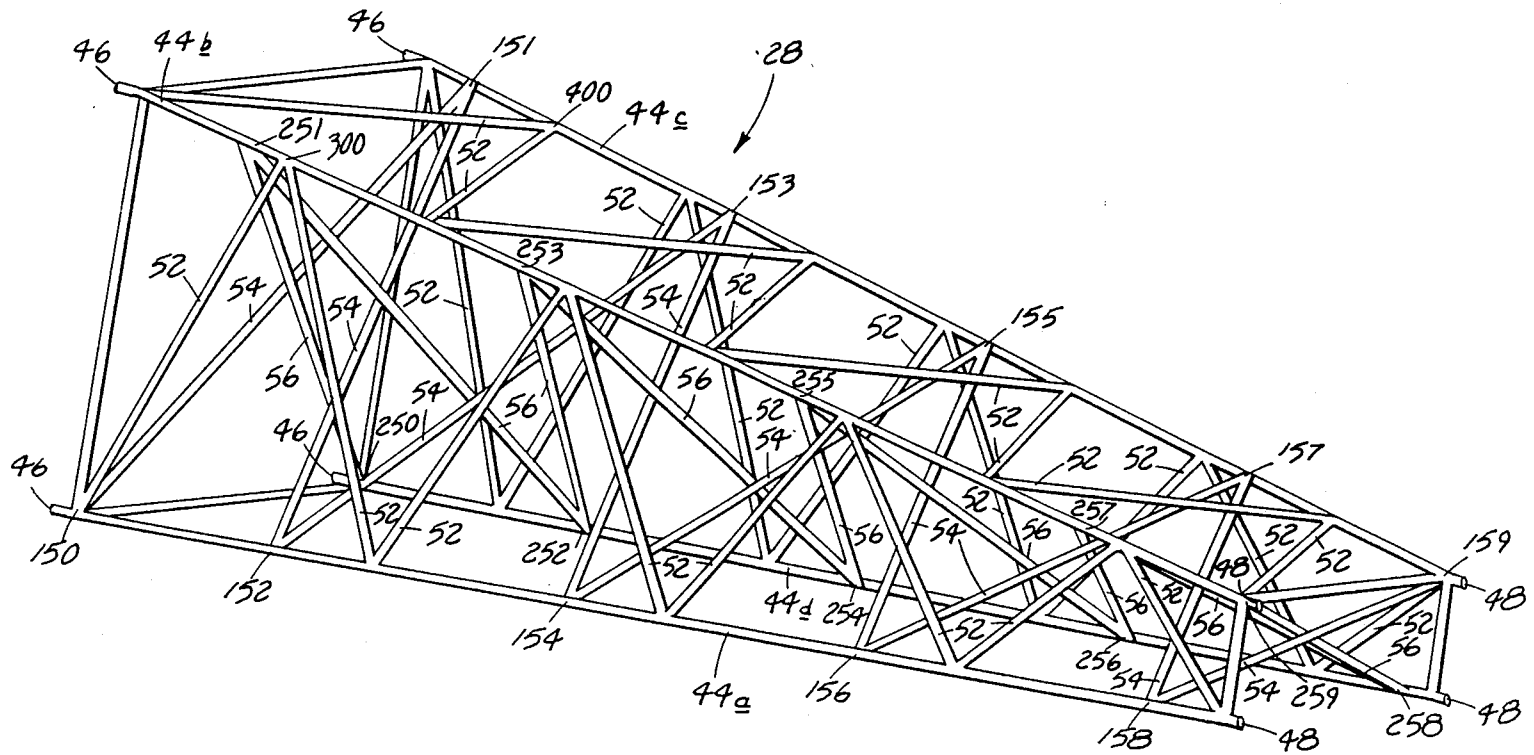
FIG. 2 is a diagrammatic perspective view of the boom tip segment of the crane and boom assembly of FIG. 1, the weldment and cable assemblies having been removed for clarity.
Figure 3:
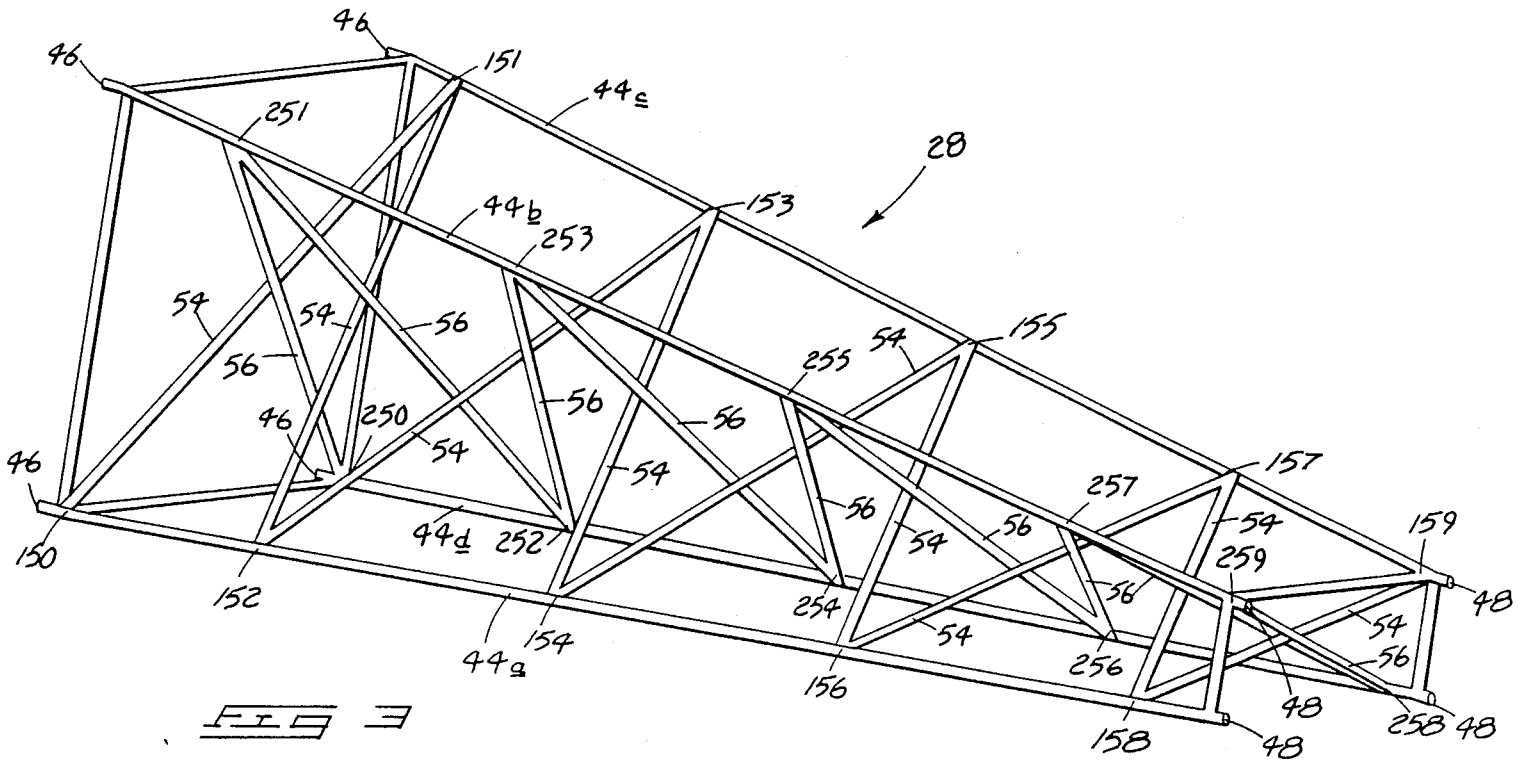
FIG. 3 is a diagrammatic perspective view of the boom tip segment of FIG. 2, the outer lacing members having been removed for more clarity.
Figure 4:
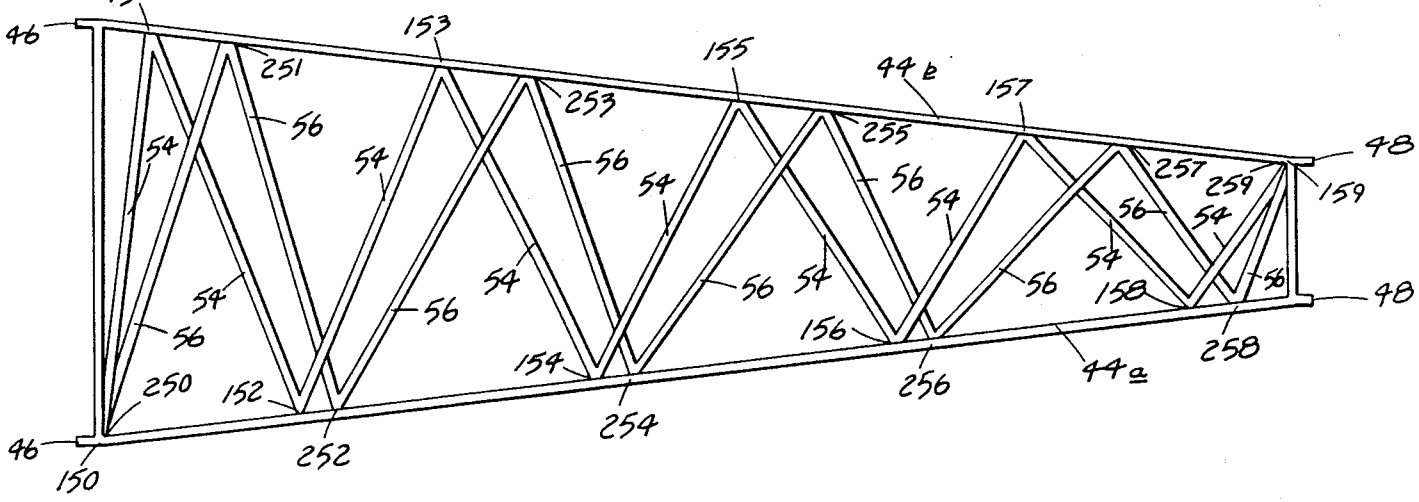
FIG. 4 is a diagrammatic side elevation of the boom tip segment as shown in FIG. 3.

The first and second sets of longitudinally spaced connection locations are preferably longitudinally offset from one another. Referring to FIG. 2, and particularly to the distal ends of rear chord members **44*b*, 44*c*, rear chord member 44*b* includes a connection location 300 from which an intersecting pair of outer lacing members 52 extend to front chord member 44*a*. Connection location 300 longitudinally corresponds with an opposed connection location 400 on adjacent rear chord member 44*c* from which an intersecting pair of outer lacing members 52 extend to rear chord member 44*b*. The distance from proximal end 46 of rear chord member 44*b* to connection location 300 is equal to the distance from proximal end 46 of rear chord member 44*c* to connection location 400. Connection location 151 on chord member 44*c* of the first set of longitudinally spaced connection locations is one-third of the distance from proximal end 46 of chord member 44*c* to location 400. On the other hand, connection location 251 on chord member 44*b* of the second set of longitudinally spaced connection locations is two-thirds of the distance from proximal end 46 of chord member 44*b* to location 300. As such, opposed connection locations 251 and 151 are longitudinally offset from one another. The remaining longitudinally opposed connection locations for the inner lacing members along each of chord members 44*a*, 44*b*, 44*c*, 44*d* are longitudinally offset from one another an equal distance. The longitudinal offset enables adjacent first and second interlacing members 54, 56, respectively to pass without interfering with one another, and distributes load more evenly along segment 28**.

With such a construction, it is apparent that the space between the pair of front chord members **44*a*, 44*d* is open along the substantial length thereof. This is desirable to enable hoist cables 40 and an upper load block 40*a* to pass through the substantial longitudinal length of cross-sectional volume 50 bounded by the four chord members 44*a*, 44*b*, 44*c* and 44*d* as necessary when boom assembly 18 supports a load when in upright, most vertical positions. The first and second sets of inner lacing members provide a necessary reinforcing effect to boom tip segment 28 eliminating the requirement for outer lacing members to extend between front chord members 44*a*, 44*d* along their length. Such a reinforcing effect provided by the diagonal interlacing members provide a boom or boom segment capable of carrying substantially the same load as the same size boom or boom segment having outer lacing members extending between the front chord members. Use of one dimensional lacings in groups 54 and 56 rather than two dimensional frames or braces to stabilize chords 44a and 44*d* limits the structural shapes required by the boom tip segment 28** to simple pipe sections, i.e. those easily fabricated and transported.

The lacing and chord members are preferably interconnected to one another using reusable interconnection means with predetermined interface clearances or tolerances. This enables the boom segment and boom assembly to be disassembled and compactly packaged for ease of transport and storage, and enables the boom assembly to be assembled to a substantially stress-free yet rigid state. Such a boom has increased load carrying capability over the same boom structure having welded or other similarly rigid joints.

The reusable interconnection means is preferably in the form of removable pins which extend through axially aligned holes formed in each of the attached chord lugs and lacing members. Referring to FIG. 6, such a reusable interconnection means is illustrated in the form of clevis assemblies. As shown, the outer ends of the lacing members include a two-pronged clevis assembly 58 having a pair of axially aligned connection holes extending therethrough. Clevis assemblies 58 fork around connection lugs or brackets 62 which radially project from the chord members. Each of lugs 62 includes at least one connection hole which is sized for axial alignment with the connection holes formed in clevis assemblies 58.

Connection lugs 62 are comprised of a plate-like member which extends radially through the chord members. One end projects through a slot formed in the chord member. The opposite end extends through an opposite radially corresponding slot to the point of being flush with the exterior of the chord member. During assembly, both ends of the lugs are welded to the chord members at the slots to provide a rigid, non-stressed interconnection lug for connection with the various lacing members.

A removable pin 64 extends through the axially aligned holes for securing the lacing members to the lugs and correspondingly the chord members. Pins 64 are lightly tapped through the holes and are retained by a hitch pin clip which snaps or expands into place upon being fully inserted. Hitch pin clips and lacing pins can be removed by a light tapping motion.

The tolerances between the received lacing pins and side walls of the holes in the clevis end lugs are preferably sufficiently great to enable the boom assembly to be assembled to a substantially stress-free yet rigid state. Such tolerances are preferably from about three thousandths of one inch to seven thousandths of one inch, with approximately five thousandths of one inch being preferred. Providing this preferred degree of tolerance enables sufficient movement between the lacing members and connection lugs to enable the boom assembly to be assembled to a substantially stress-free, yet rigid condition. Tolerances below this preferred range tend to produce a structure approximating the rigidity and having the inherent built-in stress found with entirely welded boom assemblies. A tolerance above this range enables excessive movement detracting from the desired final rigidity of the assembled structure.

A conventional clevis assembly 66 at the ends of the chord members is employed for connecting the chord members of adjacent chord segments. It preferably employs the presently accepted industry tolerances of approximately ten thousandths inch between the pins and hole sidewalls.

A boom assembly having all connections constructed in the manner specified produces a substantially stress-free boom when assembled having load carrying capacity greater than that of the same size boom with welded, rigid connections. Furthermore, the entirety of such a boom assembly can be disassembled quickly, with the individual chord and lacing members being neatly and compactly packed in storage crates for ease of transport along highways.

In compliance with the statute, the invention has been described in language more or less specific as to structural features. It is to be understood, however, that the invention is not limited to the specific features shown, since the described means and construction comprise a preferred form of putting the invention into effect. The invention is, therefore, claimed in any of its forms or modifications within the proper scope of the appended claims, appropriately interpreted in accordance with the doctrine of equivalents.

We claim:

1. A boom assembly for a crane comprising:

four longitudinal chord members defining an inner cross sectional volume bounded thereby, the chord members each having coextensive proximal and distal ends, the individual chord members presenting a pair of front, a pair of rear and two pairs of side chord members, as well as first and second pairs of diagonally opposed chord members, the chord members of each pair being separated from one another and defining a space therebetween;

support means for mounting a weldment assembly which movably carries hoist cables, the support means being mounted adjacent the distal ends of the chord members;

a plurality of outer lacing members extending between and interconnecting each of the chord members of each pair of rear and side chord members;

a first set of inner lacing members extending between and interconnecting the first pair of diagonally opposed chord members, the inner lacing members of the first set extending in intersecting pairs from a first set of longitudinally spaced connection locations;

a second set of inner lacing members extending between and interconnecting the second pair of diagonally opposed chord members, the inner lacing members of the second set extending in intersecting pairs from a second set of longitudinally spaced connection locations; and the space between the pair of front chord members being substantially open along the length thereof for enabling the hoist cables to pass through the cross sectional volume bounded by the four chord members.

2. The boom assembly of claim 1 wherein the first and second sets of longitudinally spaced connection locations are longitudinally offset from one another.

3. The boom assembly of claim 1 wherein the lacing members are interconnected to the chord members by removable pins enabling the boom assembly to be disassembled and compactly packaged for ease of transport and storage.

4. The boom assembly of claim 3 wherein the lacing members include connection holes formed therein and the chord members include connection lugs also having holes formed therein, each of the connection holes in each of the lacing members being sized and adapted for axial alignment with at least one of the connection lug holes for receiving one of the removable pins therethrough, the tolerances between the received pins and sidewalls of the above defined holes being sufficiently great to enable the boom assembly to be assembled to a substantially stress-free, yet rigid state.

5. The boom assembly of claim 4 wherein the tolerances are from three thousandths of one inch to seven thousandths of one inch.

6. The boom assembly of claim 5 wherein the tolerances are approximately five thousandths of one inch.

7. The boom assembly of claim 1 wherein the distal ends of the four chord members are closer to one another than are the proximal ends.

8. The boom assembly of claim 1 wherein:

the first and second sets of longitudinally spaced connection locations are longitudinally offset from one another;

the lacing members are interconnected to the chord members by removable pins enabling the boom assembly to be disassembled and compactly packaged for ease of transport and storage; and the distal ends of the four chord members are closer to one another than are the proximal ends.

9. The boom assembly of claim 1 wherein the most distal end lacing member of each of the first and second sets of inner lacing members extends from one of the front chord members.

10. The boom assembly of claim 1 wherein the most proximal end lacing member of each of the first and second sets of inner lacing members extends from one of the rear chord members.

11. The boom assembly of claim 10 wherein the most proximal end lacing member of each of the first and second sets of inner lacing members extends from one of the rear chord members.

12. A boom assembly for a crane comprising:

a plurality of abutting generally coaxial boom segments extending in a defined generally longitudinal direction between a heel end and a tip end, the boom segment at the heel end including means for connecting the boom assembly to a boom support structure, the tip end boom segment including support means for mounting a weldment assembly which movably carries hoist cables; the tip end boom segment comprising:

four longitudinal chord members defining an inner cross sectional volume bounded thereby, the individual chord members presenting a pair of front, a pair of rear, and two pairs of side chord members, as well as first and second pairs of diagonally opposed chord members, the chord members of each pair defining a space therebetween;

a plurality of outer lacing members extending between and interconnecting each of the chord members of each pair of rear and side chord members;

a first set of inner lacing members extending between and interconnecting the first pair of diagonally opposed chord members, the inner lacing members of the first set extending in intersecting pairs from a first set of longitudinally spaced connection locations;

a second set of inner lacing members extending between and interconnecting the second pair of diagonally opposed chord members, the inner lacing members of the second set extending in intersecting pairs from a second set of longitudinally spaced connection locations; and the space between the pair of front chord members being substantially open along the length thereof for enabling the hoist cables to pass through the cross sectional volume bounded by the four chord members.

13. The boom assembly of claim 12 wherein the first and second sets of longitudinally spaced connection locations are longitudinally offset from one another.

14. The boom assembly of claim 13 wherein the lacing members are interconnected to the chord members by removable pins, and the ends of the chord members of adjacent segments are interconnected to one another by removable pins, enabling the boom assembly to be disassembled and compactly packaged for ease of transport and storage.

15. The boom assembly of claim 14 wherein, the lacing members include connection holes formed therein;

the chord members include radially projecting connection lugs having holes formed therein;

each of the connection holes in each of the lacing members being sized and adapted for axial alignment with at least one of the holes in the radially projecting connection lugs for receiving one of the removable pins therethrough; and the tolerances between the received pins and side walls of the above defined holes being sufficiently great to enable the boom assembly to be assembled to a substantially stress-free, yet rigid state.

16. The boom assembly of claim 15 wherein the tolerances are from three thousandths of one inch to seven thousandths of one inch.

17. The boom assembly of claim 16 wherein the tolerances are approximately five thousandths of one inch.

18. A crane apparatus comprising:

a base support for engaging a surface which supports the crane apparatus;

a boom assembly mounted to the base support for pivotal movement about a generally horizontal pivot axis, the boom assembly comprising;

four longitudinal chord members defining an inner cross sectional volume bounded thereby, the chord members each having coextensive proximal and distal ends, the individual chord members presenting a pair of front, a pair of rear and two pairs of side chord members, as well as first and second pairs of diagonally opposed chord members, the chord members of each pair being separated from one another and defining a space therebetween;

support means for mounting a weldment assembly which movably carries hoist cables, the support means being mounted adjacent the distal ends of the chord members;

a plurality of outer lacing members extending between and interconnecting each of the chord members of each pair of rear and side chord members;

a first set of inner lacing members extending between and interconnecting the first pair of diagonally opposed chord members, the inner lacing members of the first set extending in intersecting pairs from a first set of longitudinally spaced connection locations;

a second set of inner lacing members extending between and interconnecting the second pair of diagonally opposed chord members, the inner lacing members of the second set extending in intersecting pairs from a second set of longitudinally spaced connection locations; and the space between the pair of front chord members being substantially open along the length thereof for enabling the hoist cables to pass through the cross sectional volume bounded by the four chord members.

19. The crane apparatus of claim 18 wherein the first and second sets of longitudinally spaced connection locations are longitudinally offset from one another.

20. The crane apparatus of claim 18 wherein the lacing members are interconnected to the chord members by removable pins enabling the boom assembly to be disassembled and compactly packaged for ease of transport and storage.

21. The crane apparatus of claim 20 wherein the lacing members include connection holes formed therein and the chord members include connection lugs also having holes formed therein, each of the connection holes in each of the lacing members being sized and adapted for axial alignment with at least one of the connection lug holes for receiving one of the removable pins therethrough;

the tolerances between the received pins and sidewalls of the above defined holes being sufficiently great to enable the boom assembly to be assembled to a substantially stress-free, yet rigid state.

22. The crane apparatus of claim 21 wherein the tolerances are from three thousandths inch to seven thousandths inch.

23. A latticework construction for a mobile crane having a forwardly extending boom assembly and a rearwardly extending mast, comprising:

a plurality of straight elongated longitudinal chord members;

a plurality of straight elongated lacing members adapted to transversely interconnect the chord members;

each chord member being provided with one or more protruding connection lugs each being in the form of a plate-like member which extends radially through the chord member and is attached at diametrically opposite sides of the chord member, one end of the plate-like member eing extended outwardly from one side of the chord member and having one or more connection holes formed therethrough;

each lacing member having first and second end sections respectively adapted to be interconnected with two of the chord members by means of releasable pin joints;

each lacing member including a two-pronged clevis at each end thereof, the prongs of each clevis being adapted to receive a connection lug between them and including paired axially aligned connection holes formed therethrough.

24. The latticework construction of claim 23 further comprising:

releasable pins adapted to be fitted between axially aligned connection holes of each clevis and a connection lug received thereby.

25. The latticework construction of claim 23 wherein the remaining end of each plate-like member is flush with the exterior of the chord member through which it extends.

26. The latticework construction of claim 23 wherein the plate-like member extends through slots at opposite sides of the chord member and is welded to the chord member at the slots.

27. The latticework construction of claim 23 further comprising:

releasable pins adapted to be fitted between axially aligned connection holes of each clevis and a connection lug received thereby;

the tolerances between the pins and connection holes being from three thousandths of one inch to seven thousandths of one inch to enable the latticework construction to be assembled to a substantially distress-free, yet rigid state.

28. The latticework construction of claim 23 further comprising:

releasable pins adapted to be fitted between axially aligned connection holes of each clevis and a connection lug received thereby;

the tolerances between the pins and connection holes being approximately five thousandths of one inch to enable the latticework construction to be assembled to a substantially distress-free, yet rigid state.

* * * * *